US005676264A

United States Patent [19]

Wilson

[11] Patent Number: 5,676,264

[45] Date of Patent: Oct. 14, 1997

[54] HYDRAULIC BOOM STOP

[75] Inventor: George Wilson, Houston, Tex.

[73] Assignee: SeaTrax, Inc., Houston, Tex.

[21] Appl. No.: 778,600

[22] Filed: Jan. 6, 1997

Related U.S. Application Data

[63] Continuation-in-part of Ser. No. 671,062, Jun. 27, 1996, abandoned.

[51] Int. Cl.[6] ..... B66C 15/00

[52] U.S. Cl. ..... 212/293; 212/280; 414/719

[58] Field of Search ..... 212/280, 293; 414/719

[56] References Cited

U.S. PATENT DOCUMENTS

| | | |
|---|---|---|
| 2,914,312 | 4/1959 | Cheesman . |
| 3,035,710 | 6/1962 | Pohl . |
| 3,082,746 | 3/1963 | Kerridge . |
| 3,094,221 | 6/1963 | Galuska . |
| 4,061,230 | 12/1977 | Goss et al. . |
| 4,184,600 | 1/1980 | Goss et al. . |
| 4,216,870 | 8/1980 | Bonneson et al. . |
| 5,310,067 | 5/1994 | Morrow . |

*Primary Examiner*—Thomas J. Brahan
*Attorney, Agent, or Firm*—Keeling Law Firm

[57] ABSTRACT

A hydraulic boom stop for a crane that permits operation at angles greater than the normal maximum operating boom angle of the crane boom. The hydraulic boom stop has at least one hydraulic cylinder and a hydraulic control system that is user controlled. The user controls the hydraulic fluid pressure to a boom control valve that in turn regulates the movement of the boom. As the hydraulic cylinder ram moves, the hydraulic fluid displaced by the ram provides a back pressure in the boom control valve that opposes and slows the continued upward or downward movement of the boom. The back pressure bleeds off through restricting valves in the communication lines. A relief valve in communication with the line associated with the inward movement of the ram releases the pressure in that line when it attains a predetermined value. In this way, the ram movement is less rigid and the hydraulic cylinder acts as an effective damper of impact forces. The user also controls the outward movement of the ram. Thus, the hydraulic boom stop acts as a kick-out device. Indicating devices, such as a horn, are included to indicate operation of the crane above the normal maximum operating boom angle of the boom.

12 Claims, 3 Drawing Sheets

HYDRAULIC BOOM STOP

This application is a continuation in art of U.S. application Ser. No. 08/671,062 filed by Wilson on Jun. 27, 1996, now abandoned.

BACKGROUND OF THE INVENTION

1. Field of Invention

This invention relates to a boom stop for cranes. More specifically, it is directed to an improved hydraulic boom stop that provides a hydraulic damper, a speed control, and a boom kick-out. In addition, the improved hydraulic boom stop enables crane operation at higher than normal boom angles.

Luffing cranes utilize a cable attached to the outer end of the boom to raise and lower the boom. Conventional luffing cranes rely on gravity to lower the boom and shortening of the cable to raise the boom. The boom of the typical luffing crane does not generally operate at extremely high angles from the horizontal due to the risks of overturning the boom. Typically, the upper limit of the boom angle is about 82 degrees from horizontal.

Luffing cranes operate in maritime shipping and other environments where space utilization efficiency is often crucial. Consequently, increasing the operable boom angle of the crane which, in turn, increases the usable surface area around the crane is a desirable feature for cranes.

In addition, winds or other factors such as the listing of a ship may force the boom to a higher angle than the crane's maximum operating boom angle. In this event, the boom may be trapped at a high angle and disable the crane.

Generally, cranes include boom stops positioned to prevent the boom from extending past the maximum operating boom angle of the crane and to prevent the boom from impacting the remainder of the crane when wind blows the boom toward the crane.

Typically, a boom stop has a rigid body that extends from the crane frame. Often the boom stop includes a spring to dampen the impact forces of the boom. When a boom contacts a boom stop having a spring design, the spring forces the boom away from the frame and creates an uncontrolled swinging of the boom. In addition, because of the significant weight of the boom, the impact can result in damage to the boom stop due to insufficient damping capacity. Efforts to provide greater damping include the use of a shock absorber.

Some cranes utilize a hydraulic cylinder that is independently, manually operated to force the crane from a trapped, high angle position.

2. Related Art

Boom stops have long been known to the prior art. U.S. Pat. Nos. 4,061,230, 4,184,600, 4,216,870, and 5,310,067 show common rigid boom stops.

Though the above mentioned boom stops for cranes may be helpful in limiting the boom movement range, they can be improved to provide greater damping and a boom kick-out, to enable crane operation at high boom angles and to provide a boom speed control at the high operating angles.

SUMMARY OF THE INVENTION

Accordingly, the objectives of this invention are to provide, inter alia, Hydraulic Boom Stop and Method that:

limits the boom movement range;

provides damping of boom impact forces;

forces the boom to an operable position in a controlled manner (i.e., provides for controlled kick-out of the boom);

enables crane operation at higher boom angles;

includes a warning device that indicates boom operation at extremely high angles;

increases the space utilization efficiency of the crane; and provides an automatic speed control for raising and lowering the boom at the high boom angles.

To achieve such improvements, my invention is a hydraulic boom stop for a crane that includes a hydraulic cylinder. A boom control means controls the upward and downward motion of the crane boom as well as fluid supply to the hydraulic cylinder. A speed control means limits the movement rate of the crane boom and the hydraulic cylinder ram in response to the movement rate of the ram. In addition, the hydraulic cylinder is positioned and constructed to receive and dampen an impact from the crane boom and to exert a force on the crane boom to facilitate its downward motion. Also, my invention is a method of controlling the speed of the crane boom at high operating angles, a method of dampening an impact of a crane boom, and a method of forcing a crane boom from an angle greater than its normal maximum operating angle that includes functionally applying the above-described apparatus.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
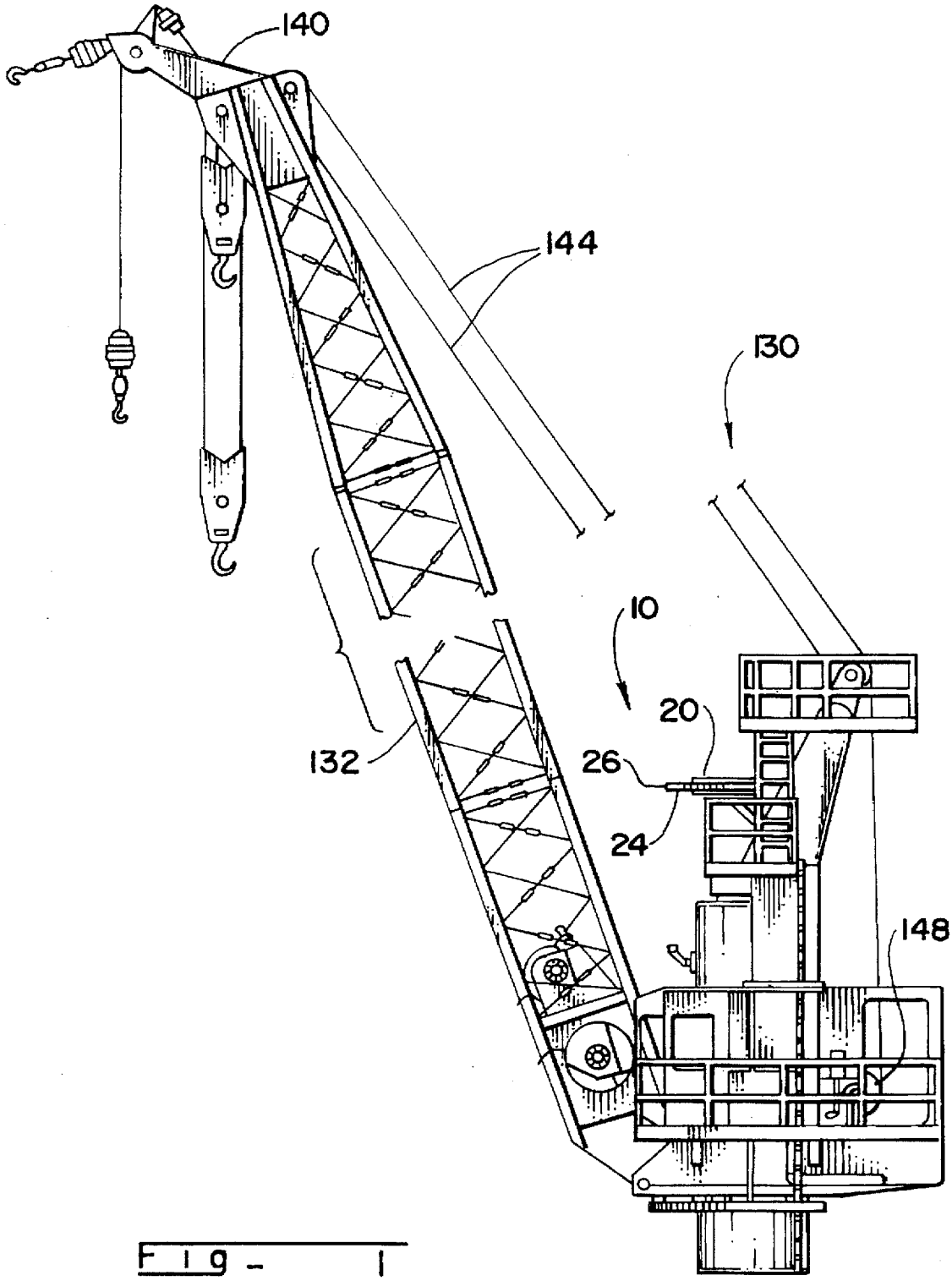
FIG. 1 is a side elevational view of the crane showing the position of the boom stop on the crane.
Figure 2:
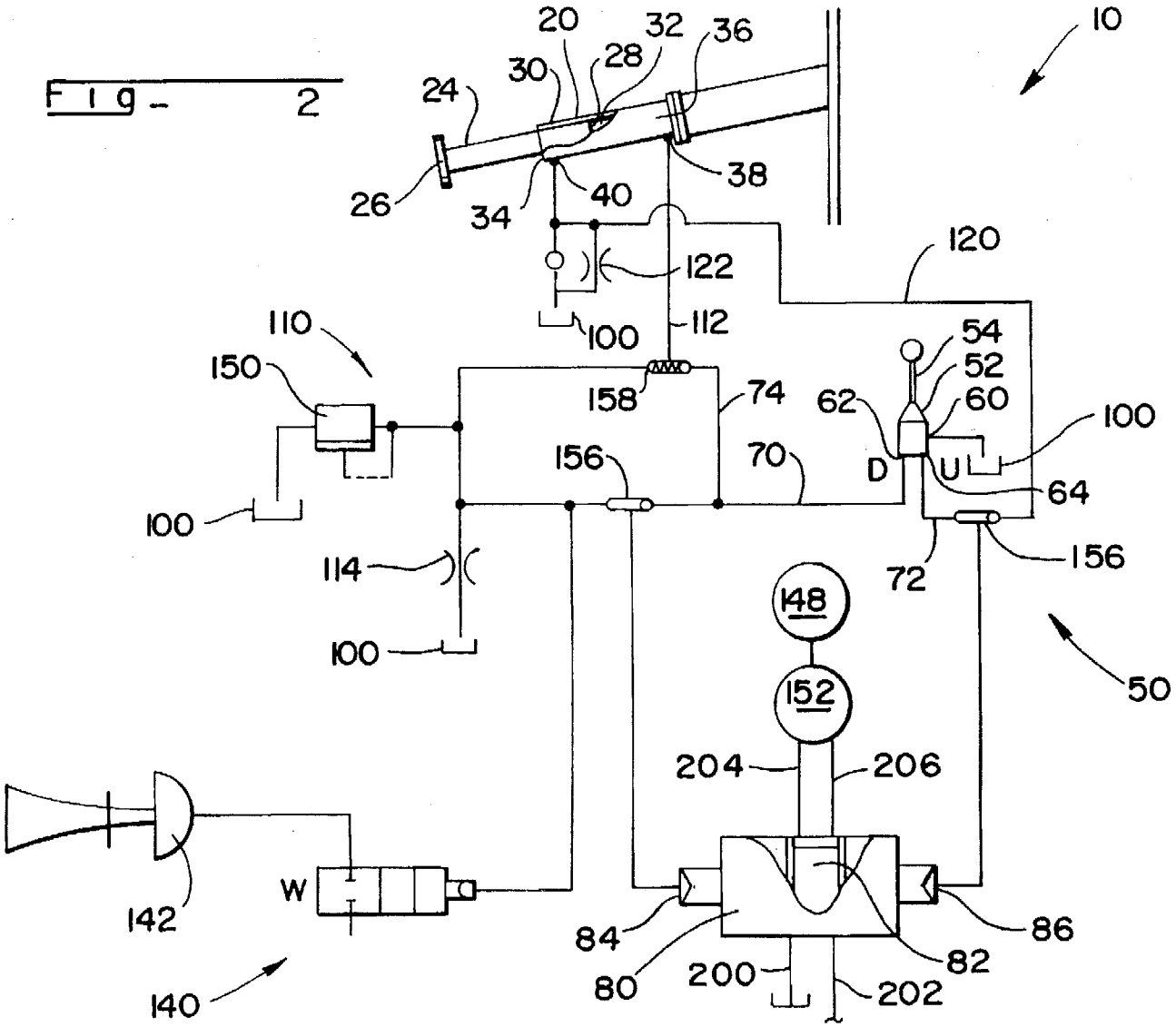
FIG. 2 is a schematic of the hydraulic boom stop and the associated control system.
Figure 3:
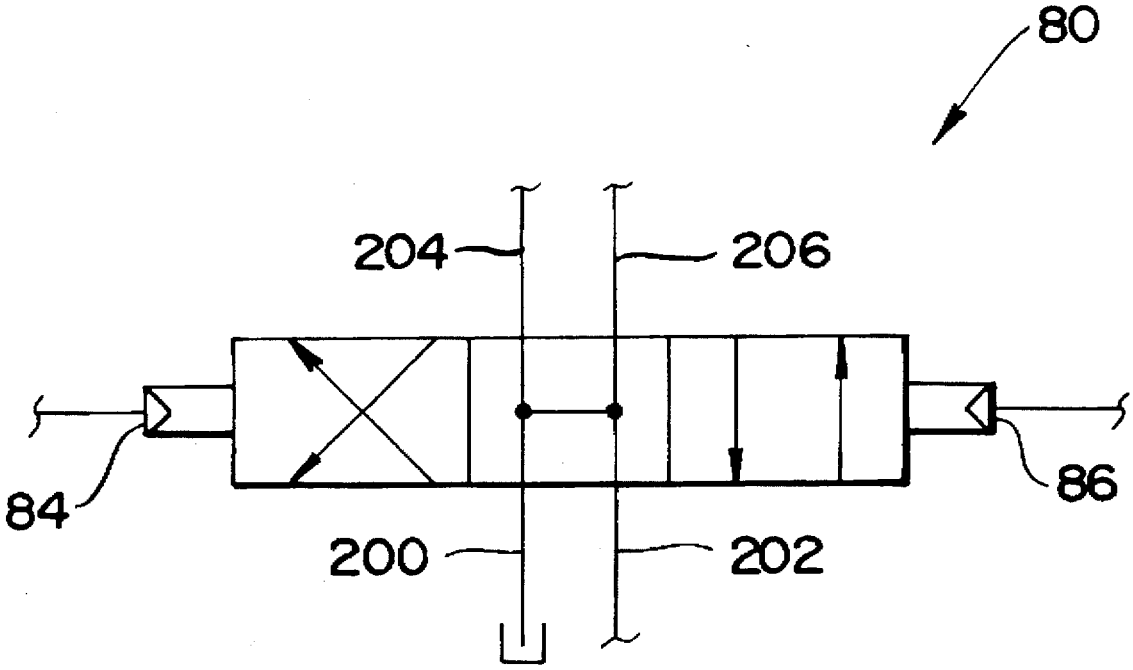
FIG. 3 is a schematic of the boom control valve and its relation to the tank return line, the oil pressure line, the motor down control line, and the motor up control line.

The preferred embodiment of my invention is illustrated in FIGS. 1 through 3 in which the hydraulic boom stop is depicted as 10. Generally, the hydraulic boom stop 10 includes a boom control means 50, at least one hydraulic cylinder 20, and a speed control means 110.

FIG. 1 depicts a crane 130 including a crane boom 132 extending from the crane 130. Typically, the crane boom 132 cannot operate at angles greater than about 82 degrees. When a crane boom 132 exceeds this normal maximum operating boom angle, the gravitational force is insufficient to move the crane boom 132 downward. The hydraulic boom stop 10 is constructed and positioned on the crane 130 to abut the crane boom 132 when the crane boom 132 reaches its normal maximum operating boom angle.

The outer end 140 of the crane boom 132 is connected to a cable 144. The cable 144 is connected to a winch 148 which, upon activation, retracts or detracts the cable 144 thereby respectively raising or lowering the crane boom 132. The winch 148 is powered and activated by a motor 152 (not shown in FIG. 1).

The motor 152 of winch 148 is controlled by the boom control means 50. Thus, the boom control means 50 controls the raising and lowering of the crane boom 132, or, in other words, the upward and downward motion of crane boom 132. The boom control means 50 includes a user controlled valve 52 and a boom control valve 80.

Referring to FIG. 2, the user controlled valve 52 of boom control means 50 is a variable pressure unit and has an inlet port 60 in flow communication with a hydraulic fluid supply 100, a first selectively opening outlet port 62 in flow communication with a boom down control line 70, and a second selectively opening outlet port 64 in flow communication with a boom up control line 72. The user controlled valve 52 provides for variable opening of the outlet ports, 62 and 64. The fluid in hydraulic fluid supply 100 may be either a liquid or a gas.

A user controls the user controlled valve 52 with a joystick 54 or other suitable controller. Moving the controller to a down position allows fluid to flow from the hydraulic fluid supply 100, through the user controlled valve's 52 first selectively opening outlet port 62, and into the boom down control line 70. In like manner, moving the controller to an up position permits fluid to flow from the hydraulic fluid supply 100, through the second selectively opening outlet port 64, and into the boom up control line 72.

Boom control valve 80 includes a sliding spool 82 therein or, in a second embodiment, one or more output pumps (not shown in the drawings). The spool 82 in the boom control valve 80 slides within valve 80 in response to the pressures applied against it created by the influx and outflux of hydraulic fluid within boom control valve 80. The spool 82, however, slides and remains between a pair of inlets, first inlet 84 and second inlet 86. The distance which spool 82 slides depends on the amount of differential pressure created by the hydraulic fluid entering boom control valve 80 through either inlet 84 or 86. The more differential pressure is created by the hydraulic fluid, the greater the force applied against the spool 82, and the further the displacement of spool 82.

In addition, the boom control valve 80 typically includes a biasing spring (not shown in the Figures) on both sides of the spool 82. Accordingly, the pressure supplied by hydraulic fluid into the boom control valve first and second inlets 84 and 86 must overcome the biasing force of the spring. With a boom control valve 80 having biasing springs, the speed control means 110 defines a maximum speed limit.

Boom control valve 80 is also in fluid communication with a tank return line 200, an oil pressure line 202, a motor down control line 204, and a motor up control line 206. Motor down control line 204 is in fluid communication with motor 152 so that when oil flows through motor down control line 204 to motor 152, motor 152 is activated, thus activating winch 148, and lowers crane boom 132. Motor up control line 206 is in fluid communication with motor 152 so that when oil flows through motor up control line 206 to motor 152, motor 152 is activated, thus activating winch 148, and raises crane boom 132. Oil pressure line 202 is in fluid communication with a pump (not shown in the Figures) which provides pressurized oil. Tank return line 200 is in fluid communication with a tank which holds return oil from motor down control line 204, motor up control line 206, and oil pressure line 202.

When the joystick 54 is in the neutral position, the spool 82 does not move and the oil pressure line 202 is connected to tank return line 200. Thus, oil flows in a closed circuit from oil pressure line 202 to tank return line 200 without flowing through and activating motor 152.

Referring to FIGS. 2 and 3, first inlet 84 of boom control valve 80 is in flow communication with the boom down control line 70. Thus, when joystick 54 is in the down position, hydraulic fluid flows from boom down control line 70, through first inlet 84 of boom control valve 80, and exerts pressure on the first inlet 84 side of the spool 82. The pressure exerted on the spool 82 by the fluid entering boom control valve 80 through first inlet 84 forces the spool 82 away from the first inlet 84. When the spool 82 is displaced, the passageway between oil pressure line 202 and tank return line 200 (established in the neutral position) is reduced. At the same time, a connection between oil pressure line 202 and motor down control line 204 is established (see inlet 84 side of boom control valve 80 in FIG. 3) thereby providing oil to the motor 152 and lowering the crane boom 132 at a given rate. Concurrently, a connection between motor up control line 206 and tank return line 200 is established (see inlet 84 side of boom control valve 80 in FIG. 3) thereby providing an exhaust line for oil out of motor 152. The rate at which crane boom 132 is lowered can be varied by the amount of oil released into motor 152. As the spool 82 is further displaced, the passageway between oil pressure line 202 and tank return line 200 is further reduced and the passageway between oil pressure line 202 and motor down control line 204 is further enlarged providing a greater flow of oil to motor 152. As the amount of oil to motor 152 is increased, the motor 152 lowers the crane boom 132 at a faster rate. And, as previously mentioned, the length of the distance spool 82 is displaced depends on the pressure created by the hydraulic fluid released by the user controlled valve 52 through the variable opening of outlet port 62 and into first inlet 84. As more pressure is applied against spool 82, spool 82 is further displaced. In this way, boom control means 50 controls the downward motion of crane boom 132 and may vary the rate of speed at which the crane boom 132 is lowered.

Again referring to FIGS. 2 and 3, second inlet 86 of boom control valve 80 is in flow communication with the boom up control line 72. Thus, when joystick 54 is in the up position, hydraulic fluid flows from boom up control line 72, through second inlet 86 of boom control valve 80, and exerts pressure on the second inlet 86 side of the spool 82. The pressure exerted on the spool 82 by the fluid entering boom control valve 80 through second inlet 86 forces the spool 82 away from the second inlet 86. When the spool 82 is displaced, the passageway between oil pressure line 202 and tank return line 200 (established in the neutral position) is reduced. At the same time, a connection between oil pressure line 202 and motor up control line 206 is established (see inlet 86 side of boom control valve 80 in FIG. 3) thereby providing oil to the motor 152 and raising the crane boom 132 at a given rate. Concurrently, a connection between motor down control line 204 and tank return line 200 is established (see inlet 86 side of boom control valve 80 in FIG. 3) thereby providing an exhaust line for oil out of motor 152. The rate at which crane boom 132 is raised can be varied by the amount of oil released into motor 152. As the spool 82 is further displaced, the passageway between oil pressure line 202 and tank return line 200 is further reduced and the passageway between oil pressure line 202 and motor up control line 206 is further enlarged thereby providing a greater flow of oil to motor 152. As the amount of oil to motor 152 is increased, the motor 152 is able to raise the crane boom 132 at a faster rate. And, as previously mentioned, the length of the distance spool 82 is displaced depends on the pressure created by the hydraulic fluid released by the user controlled valve 52 through the variable opening of outlet port 64 and into second inlet 86. As more pressure is applied against spool 82, spool 82 is further displaced. In this way, boom control means 50 controls the upward motion of crane boom 132 and may vary the rate of speed at which crane boom 132 is raised.

Boom control valve 80 and the type and manner of connections it is capable of establishing between the four lines, tank return line 200, oil pressure line 202, motor down control line 204, and motor up control line 206, is a type of valve commonly known to the prior art.

In the second embodiment, the output pumps provide an output in proportion to the hydraulic pressure supplied from the user controlled valve 52. A first output pump connected to the boom down control line 70 facilitates downward movement of the crane boom 132. Similarly, a second output pump connected to the boom up control line 72 facilitates upward movement of the crane boom 132. When using a single output pump, a control valve directs the fluid to either the boom down control line 70 or the boom up control line 72.

The boom control means 50 also controls the hydraulic fluid supply to the hydraulic cylinder 20. Referring to FIGS. 1 and 2, the hydraulic cylinder 20 has a ram 24, a cylinder wall 30, and a cylinder cavity 32 defined by the cylinder wall 30. The cylinder wall 30 has a cylinder forward end 34 and a cylinder rear end 36. Ports, 38 and 40, extend through the cylinder wall 30 and permit hydraulic fluid, which may be either a liquid or a gas, to flow in and out of the cylinder cavity 32. The inner cylinder port 38 extends through the cylinder wall 30 proximal the cylinder rear end 36; and, the outer cylinder port 40 extends through the cylinder wall 30 proximal the cylinder forward end 34.

The ram 24 has a ram outer end 26 and a distal ram inner end 28. The ram inner end 28 is positioned and maintained within the cylinder cavity 32 between the inner cylinder port 38 and the outer cylinder port 40. As the crane boom 132 reaches the normal maximum operating boom angle, the ram outer end 26 abuts the crane boom 132.

Outward motion of the ram 24 results from hydraulic fluid introduced through the inner cylinder port 38 and produces an outflow of hydraulic fluid through the outer cylinder port 40. Likewise, inward motion of the ram 24 results from the outflow of hydraulic fluid through the inner cylinder port 38.

Because the boom control means 50 also controls the hydraulic fluid supply to the hydraulic cylinder 20, the boom control means 50 controls the inward and outward motion of the ram 24. As previously mentioned, the boom control means 50 includes a user controlled valve 52 and a boom control valve 80 in one embodiment.

A ram outward movement control line 74 provides flow communication between the first selectively opening outlet port 62 and the inner cylinder port 38. Hence, when the user controlled valve 52 is in the down position, hydraulic fluid flows from the user controlled valve 52, through the ram outward movement control line 74, through the inner cylinder port 38, and into the cylinder cavity 32. If the ram 24 is not extended to its outermost position, this introduction of hydraulic fluid into the cylinder cavity 32 through the inner cylinder port 38 forces the ram 24 outward. Thus, if the crane boom 132 is in contact with the ram outer end 26, the ram 24 forces the crane boom 132 downward. In this way the hydraulic boom stop 10 facilitates the downward motion of the crane boom 132 and provides a kick-out therefor.

The speed control means 110 includes a speed control line, 112 and 120, for each movement direction of the crane boom 132 and a restricting valve, 114 and 122, in flow communication with each of the speed control lines, 112 and 120.

The first speed control line 112 provides flow communication between the inner cylinder port 38 and the boom control valve first inlet 84. Thus, when ram 24 is forced inward, hydraulic fluid escapes cylinder cavity 32 through inner cylinder port 38 and flows through first speed control line 112, through first inlet 84, and into boom control valve 80.

Therefore, two opposing forces act on the spool 82 when the crane boom 132 moves upward and contacts ram 24 forcing ram 24 inward. As previously mentioned, when a user places joystick 54 in the up position, hydraulic fluid flows from the second selectively opening outlet port 64 of user controlled valve 52 into second inlet 86 of boom control valve 80 and creates a pressurized force ("the first force") on the second inlet 86 side of spool 82. This first force displaces spool 82 away from second inlet 86 and causes crane boom 132 to move upward. When and if crane boom 132 operates at an angle high enough to contact ram 24, ram 24 will be forced inward by crane boom 132. As also previously mentioned, the inward motion of ram 24 causes hydraulic fluid within cylinder cavity 32 to flow out of inner cylinder port 38 and into boom control valve 80 through first inlet 84. The fluid entering boom control valve 80 through first inlet 84 creates a pressurized force ("the second force") on the first inlet 84 side of spool 82. This second force created by the inward movement of ram 24 opposes the first force created by the placement of joystick 54 in the up position. Thus, at the spool 82, the pressure created by the hydraulic fluid from the hydraulic cylinder 20 (the second force) opposes the pressure created by the user controlled valve 52 (the first force). Therefore, the second force decreases the amount of displacement of the spool 82 which was caused by the first force (supplied by the user controlled valve 52). Since the amount of displacement of spool 82 is reduced, the amount of oil released by boom control valve 80 into motor 152 (by the connection between oil pressure line 202 and motor up control line 206) and thus the upward movement rate of the crane boom 132 are also reduced.

A first restricting valve 114 in flow communication with the first speed control line 112 permits the release of hydraulic fluid from the first speed control line 112 at an adjustable, predetermined rate. First restricting valve 114 releases the hydraulic fluid at a relatively slow rate to permit the relatively slow, gradual release of pressure in the first speed control line 112. By reducing the pressure in first speed control line 112 and thus also the second force induced by the inward movement of ram 24 at spool 82, first restricting valve 114 decreases the second force. By decreasing the opposing second force, first restricting valve 114 allows the first force to more freely displace spool 82 thereby allowing a greater amount of oil to be released by boom control valve 80 into motor 152. A greater amount of oil injected into motor 152, as has been previously disclosed herein, corresponds to a faster upward movement rate of crane boom 132. In this way, the speed control means 110 provides for adjustable variation of the movement rate of the crane boom 132 operating above its normal maximum operating boom angle.

The second speed control line 120 provides flow communication between the outer cylinder port 40 and the boom control valve second inlet 86. Thus, when ram 24 is forced outward, hydraulic fluid escapes cylinder cavity 32 through outer cylinder port 40 and flows through second speed control line 120, through second inlet 86, and into boom control valve 80. However, it must be understood that hydraulic fluid will flow out of outer cylinder port 40 only if ram 24 is not fully extended outwardly. If ram 24 is fully extended outwardly, then no hydraulic fluid will flow out of outer cylinder port 40.

Therefore, two opposing forces act on the spool 82 when ram 24 is forced outward pushing crane boom 132 downward. As previously mentioned herein, when a user places joystick 54 in the down position, hydraulic fluid flows from the first selectively opening outlet port 62 of user controlled valve 52 into first inlet 84 of boom control valve 80 and creates a pressurized force ("the third force") on the first inlet 84 side of spool 82. This third force displaces spool 82 away from first inlet 84 and causes crane boom 132 to move downward. If crane boom 132 is operating at an angle high enough to abut ram 24, ram 24 also aids in the downward movement of crane boom 132 by extending outwardly and pushing crane boom 132 downward. Ram 24, if not already completely outwardly extended, is pushed outwardly when joystick 54 is placed in the down position thus allowing fluid to flow from user controlled valve 52, through the ram outward movement control line 74, through the inner cylinder port 38, and into cylinder cavity 32. As also previously mentioned, the outward motion of ram 24 causes hydraulic fluid within cylinder cavity 32 to flow out of outer cylinder port 40 and into boom control valve 80 through second inlet 86. The fluid entering boom control valve 80 through second inlet 86 creates a pressurized force ("the fourth force") on the second inlet 86 side of spool 82. This fourth force created by the outward movement of ram 24 opposes the third force created by the placement of the joystick 54 in the down position. Thus, at the spool 82, the pressure created by the hydraulic fluid from the hydraulic cylinder 20 (the fourth force) opposes the pressure supplied from the user controlled valve 52 (the third force). The fourth force decreases the amount of displacement of the spool 82 which was caused by the third force (supplied by the user controlled valve 52). Since the amount of displacement of the spool 82 is reduced, the amount of oil released by boom control valve 80 into motor 152 (by the connection between oil pressure line 202 and motor down control line 204) and thus the downward movement rate of the crane boom 132 are also reduced.

A second restricting valve 122 in flow communication with the second speed control line 120 permits the release of hydraulic fluid from the second speed control line 120 at an adjustable, predetermined rate. Second restricting valve 122 releases the hydraulic fluid at a relatively slow rate to permit the relatively slow, gradual release of pressure in the second speed control line 120. By reducing the pressure in the second speed control line 120 and thus also the fourth force induced by the outward movement of ram 24 at spool 82, second restricting valve 122 decreases the fourth force. By decreasing the opposing fourth force, second restricting valve 122 allows the third force to more freely displace spool 82 thereby allowing a greater amount of oil to be released by boom control valve 80 into motor 152. A greater amount of oil injected into motor 152, as has been previously disclosed herein, corresponds to a faster downward movement rate of crane boom 132. In this way, the speed control means 110 provides for adjustable variation of the movement rate of the crane boom 132 operating above its normal maximum operating boom angle.

The crane boom 132 may move at a high upward movement rate due to many factors such as operator error, wind acting on the crane boom 132, or listing of the supporting ship. Thus, the crane boom 132 may contact the ram outer end 26 at a high rate of speed, hereinafter referred to as an impact from the crane boom 132. To prevent damage to the hydraulic boom stop 10 and to provide for damping of the impact from the crane boom 132, the hydraulic boom stop 10 includes a relief valve 150 in flow communication with the first speed control line 112. The relief valve 150 releases hydraulic fluid from the first speed control line 112 when the pressure in the first speed control line 112 reaches a predetermined level. Therefore, relatively rapid inward movement of the ram 24 results in a release of hydraulic fluid from the first speed control line 112. In this way, the hydraulic boom stop 10 provides a less rigid damper to receive and dampen the impact from the crane boom 132. Unlike a spring damper, the hydraulic boom stop 10 does not exert an immediate return force on the crane boom 132. The return force of a spring causes an uncontrolled downward movement of the crane boom 132 that can be dangerous. To the contrary, the ram 24 of the hydraulic boom stop 10 remains in the hydraulic cylinder 20 until intentionally forced out as described above.

For increased safety, the hydraulic boom stop 10 may include warning devices that indicate operation of the crane 130 above the normal maximum operating boom angle of the crane boom 132. Indicative of such devices is a ram inward movement indicator 140 that detects pressure in the first speed control line 112 and indicates same. One example of a ram inward movement indicator 140 is a sound emitting horn 142.

As shown in the drawing, shuttle valves 156 may be employed to direct the flow of the hydraulic fluid to the appropriate line. The typical shuttle valve 156 has two inlets and a single outlet. A valve ball within the shuttle valve 156 permits flow through only one inlet at a time and responds to fluid pressure applied thereto. In this way, the shuttle valve 156 facilitates control of the hydraulic fluid through the appropriate lines only. The spring offset shuttle valve 158 operates similarly to a standard shuttle valve 156. However, the spring offset shuttle valve 158 includes a spring that biases the valve ball toward one of the inlets.

A method for controlling the speed of a crane boom 132 operating at high angles, for safely dampening the impact of a crane boom 132, and for forcing a crane boom 132 from an angle greater than its normal maximum operating boom angle is to functionally apply the above-described hydraulic boom stop 10.

The foregoing disclosure and description of the invention is illustrative and explanatory thereof. Various changes in the details of the illustrated construction may be made within the scope of the appended claims without departing from the spirit of the invention. Two examples of such changes are that either or both of the hydraulic circuits which comprise the boom control means 50 and the speed control means 110 may be transformed into electronic circuits that perform the same functions as the hydraulic circuits disclosed in this invention by a person knowledgeable in both fields. Such electronic circuits would be considered to be within the scope of the claims and the spirit of the invention. The present invention should only be limited by the following claims and their legal equivalents.

I claim:

1. A hydraulic boom stop for a crane comprising:

boom control means for controlling the upward and downward motion of a crane boom;

at least one hydraulic cylinder having a ram positioned to slide therein;

said boom control means also for controlling the fluid supply to said at least one hydraulic cylinder and, thereby, controlling the inward and outward motion of said ram; and speed control means for limiting the movement of said crane boom and said ram to predetermined rates in response to the movement rates of said ram.

2. A hydraulic boom stop for a crane as claimed in claim 1 wherein said boom control means comprises:

a user controlled valve having an inlet port in flow communication with a hydraulic fluid supply;

said user controlled valve having a first selectively opening outlet port in flow communication with a boom down control line; and said user controlled valve having a second selectively opening outlet port in flow communication with a boom up control line.

3. A hydraulic boom stop for a crane as claimed in claim 2 wherein said boom control means further comprises:

a boom control valve;

a sliding spool in said boom control valve that slides in response to forces, created by hydraulic pressure forces, applied thereto;

said sliding spool position providing for the variable movement rate of said boom;

said boom control valve having a first inlet in flow communication with said boom down control line;

said boom control valve having a second inlet in flow communication with said boom up control line; and said sliding spool positioned in said boom control valve between said first inlet and said second inlet.

4. A hydraulic boom stop for a crane as claimed in claim 3 wherein said at least one hydraulic cylinder comprises:

a cylinder wall having a cylinder forward end and a cylinder rear end and defining a cylinder cavity;

said ram having a ram outer end and a distal ram inner end;

said ram inner end positioned and maintained in said cylinder cavity;

an inner cylinder port extending through said cylinder wall positioned proximal said cylinder rear end and maintained rearward said ram inner end;

an outer cylinder port extending through said cylinder wall positioned proximal said cylinder forward end and maintained forward said ram inner end;

whereby an outward motion of said ram results from hydraulic fluid introduced through said inner cylinder port and causes hydraulic fluid to flow out through said outer cylinder port; and whereby an inward motion of said ram results from hydraulic fluid introduced through said outer cylinder port and causes hydraulic fluid to flow out through said inner cylinder port.

5. A hydraulic boom stop for a crane as claimed in claim 4 wherein said speed control means comprises:

a first speed control line providing flow communication between said inner cylinder port and said boom control valve first inlet;

so that hydraulic fluid forced through said inner cylinder port in response to inward movement of said ram produces a pressure in said boom control valve that opposes the pressure supplied by hydraulic fluid into said boom control valve second inlet from said user controlled valve; and a first restricting valve in flow communication with said first speed control line for selectively releasing the hydraulic fluid from said first speed control line.

6. A hydraulic boom stop for a crane as claimed in claim 5 further comprising a ram inward movement indicator that detects pressure in said first speed control line and indicates same.

7. A hydraulic boom stop for a crane as claimed in claim 6 wherein said ram inward movement indicator comprises a sound emitting horn.

8. A hydraulic boom stop for a crane as claimed in claim 5 wherein said speed control means comprises:

a second speed control line providing flow communication between said outer cylinder port and said boom control valve second inlet;

so that hydraulic fluid forced through said outer cylinder port in response to outward movement of said ram produces a pressure in said boom control valve that opposes the pressure supplied by hydraulic fluid into said boom control valve first inlet from said user controlled valve; and a second restricting valve in flow communication with said second speed control line for selectively releasing the hydraulic fluid from said second speed control line.

9. A hydraulic boom stop for a crane as claimed in claim 8 wherein said at least one hydraulic cylinder positioned and constructed to receive and dampen an impact from a crane boom.

10. A hydraulic boom stop for a crane as claimed in claim 9 further comprising:

a relief valve in flow communication with said first speed control line;

said relief valve constructed to release hydraulic fluid from said first speed control line when the pressure in said first speed control line reaches a predetermined level; and so that said hydraulic cylinder provides for damping of a boom during impact conditions.

11. A hydraulic boom stop for a crane as claimed in claim 10 further comprising said at least one hydraulic cylinder positioned and constructed to exert a force on said crane boom and, thereby, facilitate downward motion of said crane boom in response to the opening of said first selectively opening outlet port of said user controlled valve.

12. A hydraulic boom stop for a crane comprising:

at least one hydraulic cylinder having a ram;

boom luffing means including boom control means for controlling the upward and downward motion of a crane boom;

said boom control means also for controlling the fluid supply to said hydraulic cylinder and, thereby, controlling the inward and outward motion of said ram; and said at least one hydraulic cylinder positioned and constructed to exert a force on said crane boom and, thereby, facilitate downward motion of said crane boom.

* * * * *